US009133624B2

(12) United States Patent
Danziger

(10) Patent No.: US 9,133,624 B2
(45) Date of Patent: Sep. 15, 2015

(54) STAIR CLIMBING ASSISTANCE DEVICE

(71) Applicant: Richard Danziger, Hauppauge, NY (US)

(72) Inventor: Richard Danziger, Hauppauge, NY (US)

( * ) Notice: Subject to any disclaimer, the term of this patent is extended or adjusted under 35 U.S.C. 154(b) by 0 days.

(21) Appl. No.: 14/096,996

(22) Filed: Dec. 4, 2013

(65) Prior Publication Data

US 2014/0150354 A1 Jun. 5, 2014

Related U.S. Application Data

(60) Provisional application No. 61/733,387, filed on Dec. 4, 2012.

(51) Int. Cl.
*B66B 9/00* (2006.01)
*E04F 11/18* (2006.01)

(52) U.S. Cl.
CPC ..... *E04F 11/1863* (2013.01)

(58) Field of Classification Search
CPC ..... E04F 11/1863; B66B 23/22; B66B 9/08; B66B 2009/0892; A61H 3/00
USPC ..... 52/29, 31, 32, 41, 750, 174, 64, 67; 198/335, 336, 337, 338
See application file for complete search history.

(56) References Cited

U.S. PATENT DOCUMENTS

| | | | | |
|---|---|---|---|---|
| 4,899,989 | A | 2/1990 | Kitson | |
| 5,022,197 | A | 6/1991 | Aragona | |
| 5,269,227 | A * | 12/1993 | Warren et al. | 105/29.1 |
| 5,337,528 | A | 8/1994 | Jaworski | |
| 6,439,544 | B1 | 8/2002 | Rosenberg | |
| 6,793,258 | B2 | 9/2004 | Gray | |
| 7,395,764 | B2 | 7/2008 | Debrunner | |
| 7,870,685 | B2 * | 1/2011 | Wurm | 38/3 |
| 7,870,695 | B2 | 1/2011 | Manson | |
| 7,950,498 | B2 * | 5/2011 | Yang et al. | 182/206 |
| 2003/0079417 | A1 * | 5/2003 | Bonin | 52/29 |
| 2006/0243112 | A1 * | 11/2006 | Debrunner | 83/455 |
| 2013/0299305 | A1 * | 11/2013 | Vlasak | 198/337 |

FOREIGN PATENT DOCUMENTS

GB 2440387 B 7/2011

* cited by examiner

*Primary Examiner* — William Gilbert
*Assistant Examiner* — Gisele Ford
(74) *Attorney, Agent, or Firm* — Myers Wolin, LLC

(57) ABSTRACT

One embodiment of a support assembly comprises an elongated rail, a support sleeve slidable along the elongated rail, a handle attached to the support sleeve and having a central axis, a first grip and a second grip on opposite sides of the central axis and each grip being connected to the other by first and second connecting members that combine with the first and second grips to form a handle frame.

16 Claims, 7 Drawing Sheets

STAIR CLIMBING ASSISTANCE DEVICE

CROSS-REFERENCE TO RELATED APPLICATIONS

This application claims the benefit of U.S. Provisional Application No. 61/733,387, filed Dec. 4, 2012, the contents of which are incorporated by reference herein.

FIELD OF THE INVENTION

The present invention relates to a support assembly for assisting a person in traversing a distance generally, and more specifically to a support assembly for assisting in the ascending and descending of a staircase.

BACKGROUND

Falls, slips and trips are among the most common accidents leading to injuries for the elderly. This is particularly true around the home while traveling across structures that are more difficult to traverse, such as stairways. Stairways present particular dangers, because the elderly are forced to lift their legs more than they normally would. Because of the added height of the person climbing, the risk of damage from a fall on a staircase is greater as well. Further, the danger of falling on staircases causes many who own homes to avoid staircases, and therefore avoid using multiple stories within their own home. This lowers the potential for exercise among the elderly, and reduces opportunities for contact with people outside the home.

Many devices exist in the prior art for assisting the elderly in climbing or descending staircases. The vast majority of these devices lack meaningful adjustments for users, so that not only must a user, for example, grasp a device at a fixed level that cannot be adjusted for their personal use, but that level is the same for users ascending and descending stairs. That means that a user may reach upwards to grasp the device when ascending stairs, making it difficult to hold for an extended period of time due to difficulty in extending arms upwards. It also means that the same user may have to reach downwards to grasp the same device when descending stairs, causing the user to hunch over, damaging posture and creating additional danger due to the user traversing the staircase in an unnatural position.

In one example, the device shown in GB 2440387 provides a bar for gripping that extends horizontally across a staircase at the height of a handrail. Similar issues plague the device of U.S. Pat. No. 7,870,695. Other devices require complicated and expensive installations, or lack the stability required. Some such devices are integrated into canes, or walkers, but those devices lack the stability possibly by fixing a device relative to the space or structure being traversed.

Maintaining stability and proper posture are critical for the comfort, health, and safety of users, while maintaining proper posture can also ease strain on the back and legs, among other stressed body parts. Further advantages may be provided using add on components to, for example, maintain trays to allow users to grasp grips with both hands instead of using one hand to carry an item or to maintain a drink or food in a stable position.

What is needed is a new type of support device for assisting a user in traversing some distance or structure, such as a staircase, while maintain proper posture in both ascending and descending such a staircase, without requiring substantial adjustments between uses. Such a support device should be stable, simple, and provide comfort, safety, and other benefits for a user.

SUMMARY

In one embodiment, there is provided a support assembly comprising an elongated rail, such as might be attached to and/or function as a handrail, a support sleeve slidable along the elongated rail, and a handle attached to the support sleeve. The handle has a central axis, a first grip and a second grip on opposite sides of the central axis, wherein each grip is preferably connected to the other by first and second connecting members that combine with the first and second grips to form a handle frame. In one embodiment, a user holds onto one or more of the grips on the handle frame while ascending or descending a flight of stairs, for example, with such movement being assisted by the sliding of the support sleeve along the elongated rail.

DETAILED DESCRIPTION OF THE PREFERRED EMBODIMENTS

Figure 1:
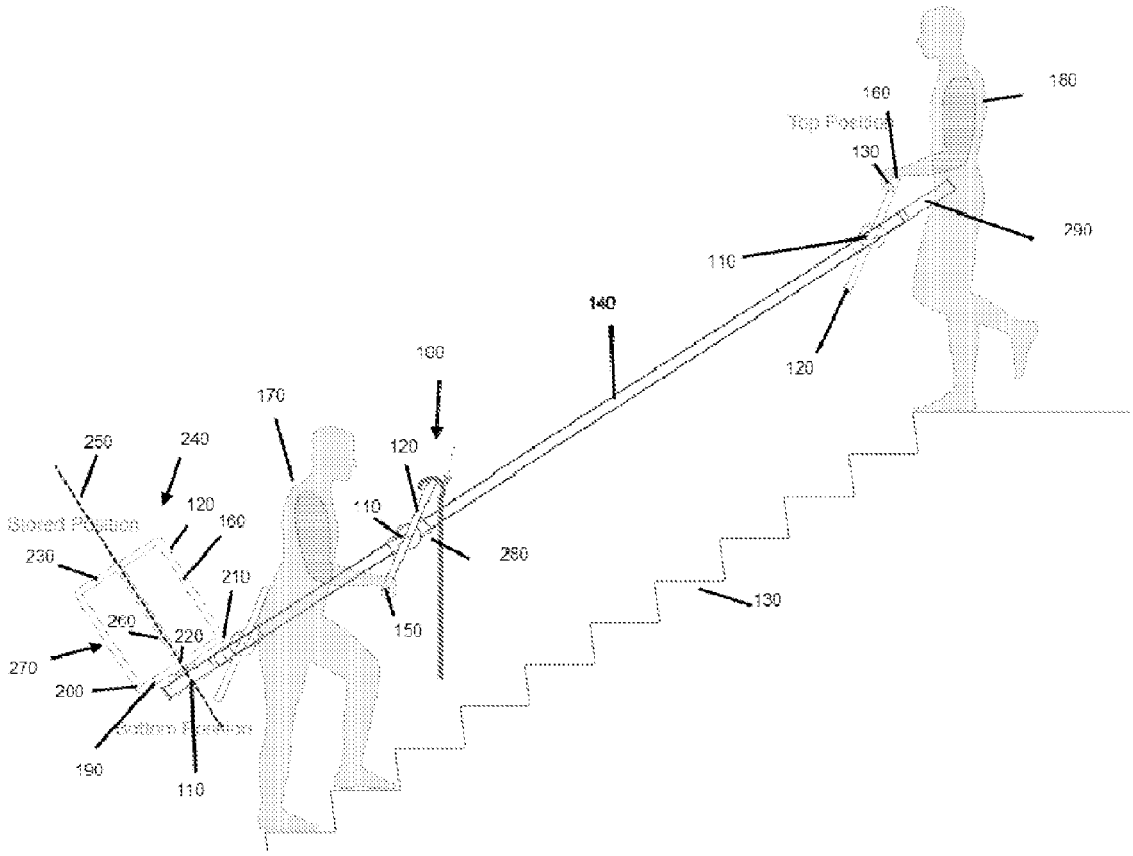
FIG. 1 shows a side view of one embodiment of a support assembly according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 2:
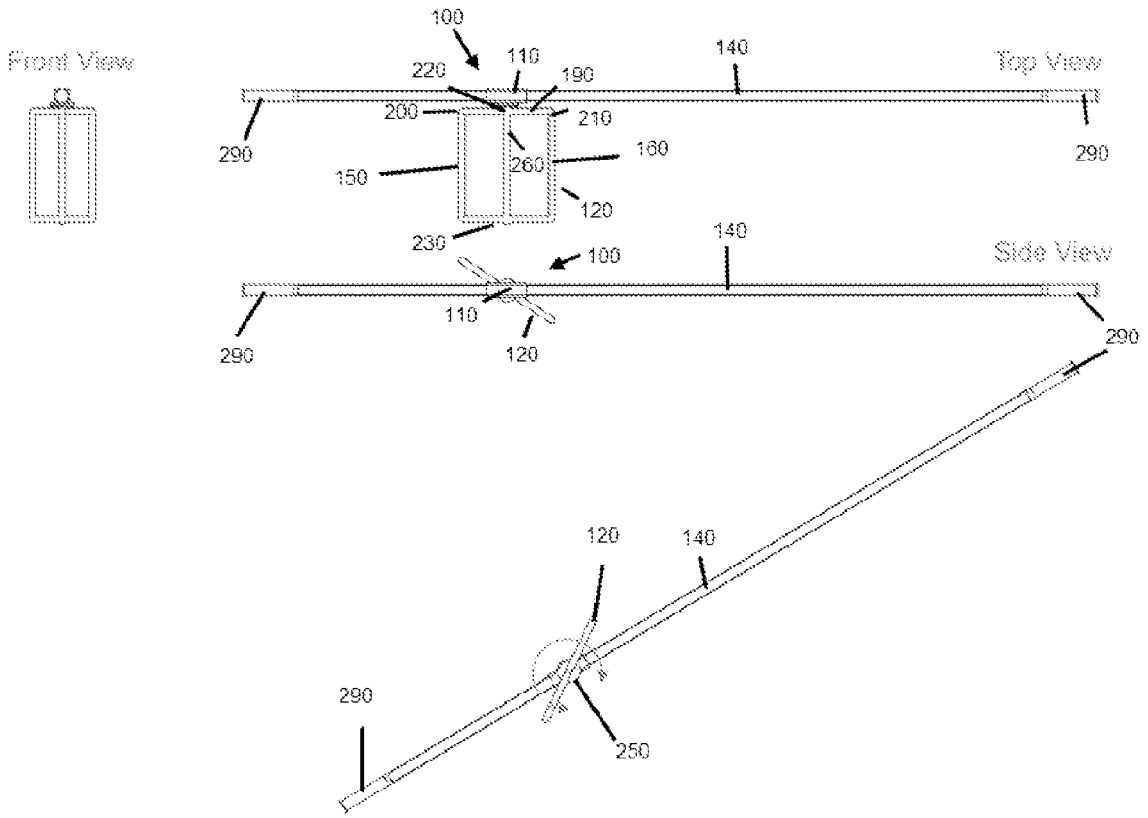
FIG. 2 shows several alternative views of one embodiment of the support assembly according to FIG. 1.

FIGS. 1-2 show a side view and a top view of one embodiment of a support assembly 100 according to the present invention. In the illustrated embodiment, the support assembly 100 comprises a support sleeve 110 with an attached handle 120 for a user 170, 180 to grasp while ascending and descending stairs 130. It will be understood that in some embodiments, support assembly 100 may provide support for a user ascending or descending a different inclined surface, such as a ramp, or traversing a flat surface. In the illustrated embodiment, support sleeve 110 slides along a rail 140 following the incline of the stairs 130. Typically, the rail 140 is a specialized handrail installed to interface with support sleeve 110, but in some embodiments, support sleeve 110 can be retrofitted to or simply attached to an existing support such an existing handrail or the like. In the illustrated embodiment, the handle 120 is movable relative to rail 140 between a storage position 270 and a use position 280, whereby the handle 120 may be movable relative to the support sleeve 110 or the handle 120 and support sleeve 110 may be collectively movable relative to the rail 140. Other configurations are possible. In the certain embodiments, the handle 120 may only be movable to storage position 270 at designated portions 290 along the rail 140 such as, for example, along the ends 290 of the rail 140.

Handle 120 extends outwardly relative to the support sleeve 110 at least partially across stairs 130 and has a first grip 150 to be grasped by a person 170 ascending stairs 130 and a second grip 160 to be gripped by a person 180 descending stairs 130. In various embodiments, a user may grasp the grips 150, 160, to prevent falling when traversing any area along rail 140, with first grip 150 supporting a user while traversing the area in one direction and the second grip 160 supporting a user while traversing the area in a second direction. While the first grip 150 and the second grip 160 are described relative to the position of a user situated on stairs or the like, it will be appreciated that a user may, if desired, use the grip 150 while descending stairs and similarly a user may use the grip 160 while ascending stairs. In addition, a user may, if desired, grasp both grips 150 and 160 during various stages of movement if additional stability is desired. Further, while each grip 150, 160 may be structurally and/or functionally similar or identical, grip 150 may, for example, be specifically adapted and ergonomically configured to accommodate a user's grip during ascent and may be provided with, for example, additional gripping support where the user's fingers contact the grip. Similarly, grip 160 may, for example, be specifically adapted and configured to accommodate a user's grip during descent and may be provided with, for example, additional gripping support where the user's palm impacts the grip 160. The grips may incorporate other structural and/or ergonomic features as desired for particular environments.

When in use, in one non-limiting embodiment, support sleeve 110 slides in the direction of the user's motion along rail 140, and supports the handle 200 that extends outwardly from the sleeve 110 and generally perpendicular to the direction of motion of the user. The user may thereby grasp grips 150, 160 extending directly in front of him or her in order to prevent falling while in motion.

First grip 150 and second grip 160 are preferably linked by a first connecting member 190 having a first end 200 connecting to first grip 150, a second end 210 connecting to second grip 160, and a central connection point 220 for connecting to the support sleeve 110. In some embodiments, a second connecting member 230 also connects to the first grip 150 and the second grip 160 and the two connecting members 190, 230 and the two grips 150, 160 combine to form a handle frame 240. In some embodiments, the handle frame 240 is rotatable about central axis 250 (FIG. 1) that bisects handle frame 240. A bisector 260 may connect the first connecting member 190 to the second connecting member 230, bisecting handle frame 240 along central axis 250.

Handle frame 240, as shown in certain embodiments, takes the form of a substantially rectangular configuration bisected by bisector 260, although other shapes are contemplated. In some embodiments, for example, the handle frame may be circular or oval and contain a pair of grips on opposite sides of a central axis. Further, grips may be shaped for easier grasping, and may therefore wrap around a user, or provide grips at more comfortable locations of a user to grasp. Several non-limiting alternative embodiments incorporating several of these features are discussed below.

In the illustrated embodiment, handle frame 240 rotates about central axis 250 in order to adjust the orientations of grips 150, 160 for the user. Because the grips are offset from central axis 250, they may be adjusted by the user in each direction, and in most cases, the grips do not require substantial adjustment between uses in the different directions. Because only one of grips 150, 160 are preferably in use at any given time, the unused grip may be used for hanging an item, such as cane 265 (FIG. 1).

In some embodiments, support sleeve 110 is configured to limit the rate of movement of handle 120 along rail 140. Support sleeve may be configured with frictional surfaces so that support sleeve 110 buckles relative to rail 140 when force is applied in a direction other than the direction of travel. Similarly, support sleeve 110 may contain a friction wheel that allows the user to select a direction of travel, or limit the rate at which support sleeve 110 can move along rail 140 under force applied during normal use.

Figure 3:
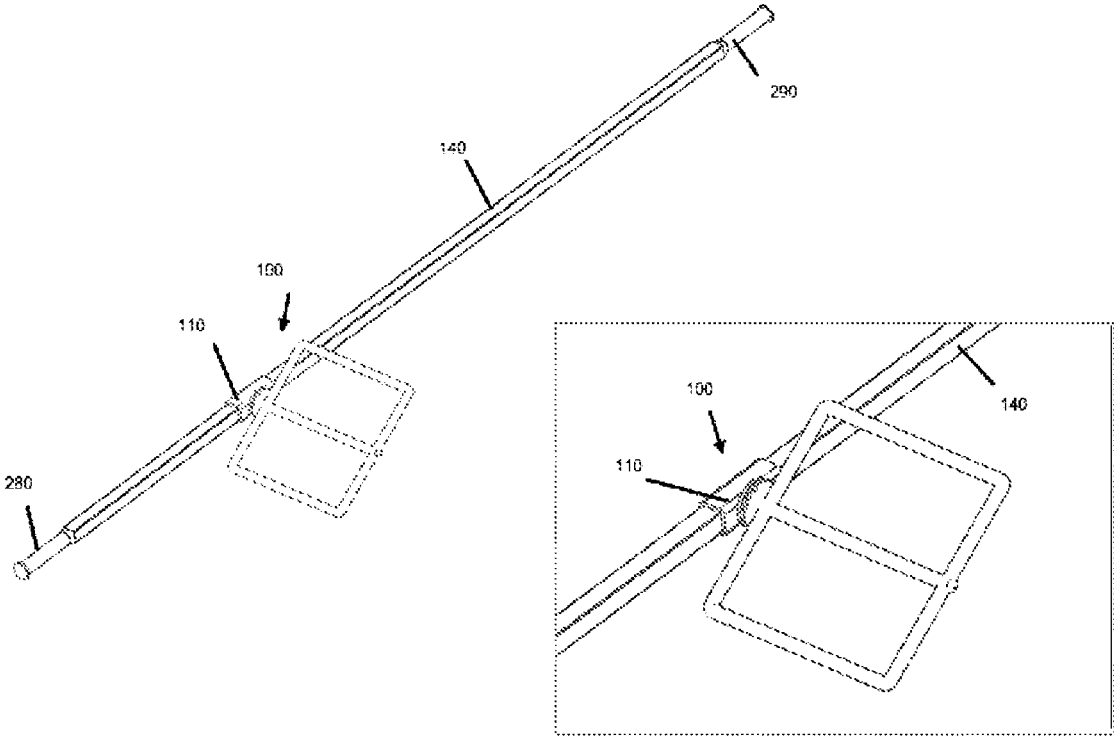
FIG. 3 shows of one embodiment of a perspective view of the support assembly of FIG. 1

FIG. 3 shows one embodiment of a perspective view of the support assembly 100 of FIG. 1 showing the support sleeve 110 and rail 140. In the illustrated embodiment, support sleeve 110 is a substantially square saddle that travels along a substantially square rail 140. Rail 140 may be provided with substantially cylindrical portions at ends 290 where handle 120 is movable between a storage position and a use position (see FIG. 1).

Figure 4:
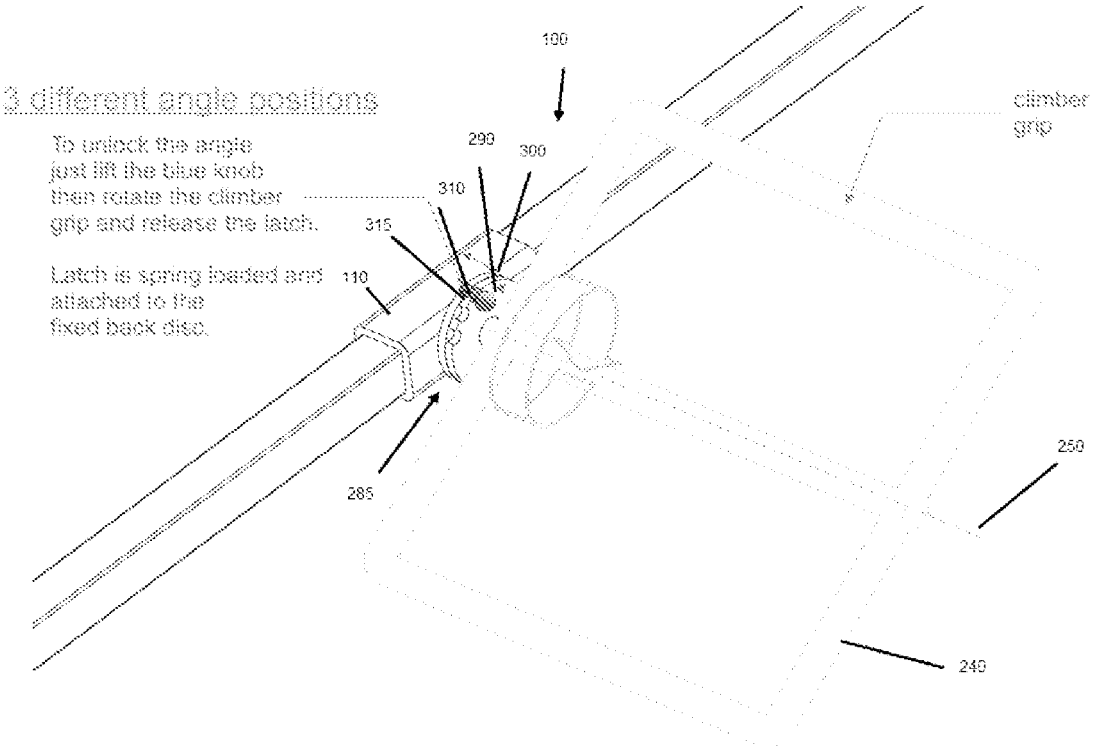
FIG. 4 shows of one embodiment of a handle frame for use in the support assembly of FIG. 1.

FIG. 4 shows a handle frame 240 of support assembly 100 of FIG. 1. Handle frame 240 is rotatable about central axis 250. The rotation of handle frame 240 may be implemented, in some examples, with a system of rotating disks 285 that locks in various orientations. In the embodiment shown, a first disk 290 associated with the handle frame 240 rotates relative to a second disk 300 fixed to support sleeve 110. The second disk 300 supports a pin 310 with preferably a single notch 315. The first disk 290 contains a plurality of notches 320 that can support pin 310, locking handle frame 240 to a single orientation about central axis 250. While only three notches 320 are shown, it will be appreciated that fewer notches may be used, or a plurality of notches 320 may be situated around the entirety of the first disk 290 to allow for a complete rotation of the handle frame 240 relative to the support sleeve 110. In the embodiment shown, pin 310 is fixed to the single notch 315 of second disk 300 and is preferably spring-loaded so that pin 310 can be moved to any one of the plurality of notches 320. It will be understood that alternative mechanisms may be used for locking the position of handle frame 240 about central axis 250 relative to the support sleeve 110.

Figure 5:
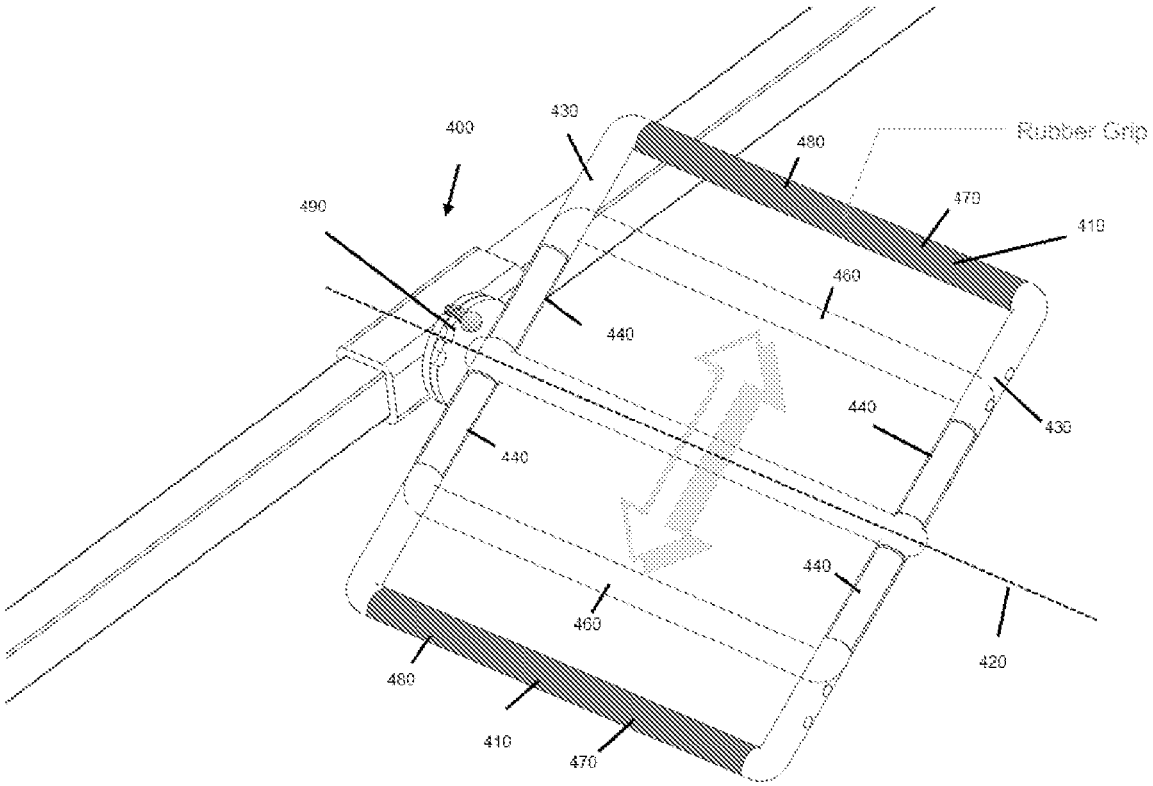
FIG. 5 shows additional features implemented in a second embodiment of a support assembly in accordance with the present invention.

FIG. 5 shows additional features implemented in a second embodiment of a support assembly 400 having two grips 410 that are extendable relative to a central axis 420 along two connecting members 430. In the embodiment shown, connecting members 430 comprise telescopically expanding portions 440, allowing each grip 410 to extend independently of the other, providing a user with more control over the location of the grip 410. Each grip 410 may thereby be positioned in at least a first position 460 and a second position 470. It will be understood that in some embodiments, grips 410 may be provided with a larger number of adjustments, or may be infinitely adjustable. It will also be understood that although telescopic expansion is shown, the expansion may be through alternative mechanisms, such as additional parts that may be added to handle frame 450 or a folding mechanism, among others.

The independent adjustment of the grips 410 allows a taller user or shorter user to adjust each grip 410 to a different point as needed, while a rotation adjustment 490, such as the mechanism described in FIG. 3, allows the user to select an orientation for grips 410. In this way, a user can adjust the extension once using the telescopic 440 function of handle frame 450, and rotate the handle frame 450 relative to the central axis 420. In this way, a user may avoid the need to make substantive adjustments on a regular basis.

In the illustrated embodiment, the grips 410 are covered in a rubberized material 480 allowing for easy and comfortable gripping of handle frame 450. It will be understood that the grips may be made out of or coated with many materials for the purposes of comfort and ease of gripping, as well as increased gripability, including rubber, neoprene, appropriately molded plastic, or a high friction tape among others. In some embodiments, additional grips may be provided to allow for additional gripping surfaces. The additional grips may be permanently implemented, or they may be removable (not shown) when not in use. In one embodiment, addition grip overlays or covers may be attached to or over the grips 410 to provide a user with a varied tactile experience.

Figure 6:
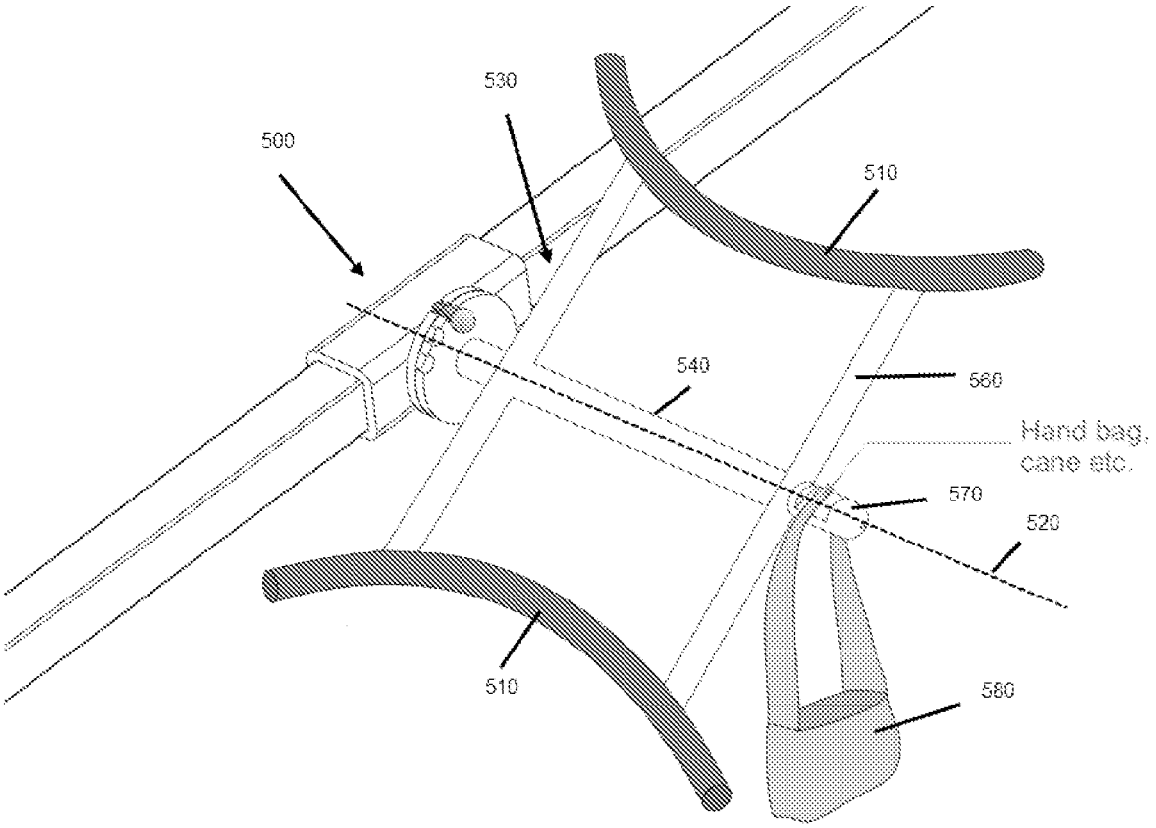
FIG. 6 shows additional features implemented in a third embodiment of a support assembly in accordance with the present invention.

FIG. 6 shows additional features implemented in a third embodiment of a support assembly 500 having curved grips 510 that arch inwards towards a central axis 520. This configuration provides a user with a varied gripping surface that provides additional positional flexibility on how the user may grip the support assembly 500 in potentially more convenient locations. For example, a user may prefer holding the grips 510 next to him or her while using support assembly 500. In other embodiments, grips and/or gripping surfaces may take different shapes, providing more or less an enclosure to the user. In certain embodiments, a handle frame 530 may be substantially rectangular with additional grips extending from corners.

Additionally, support assembly 500 further comprises a bisector 540 along central axis 520 that connects a first connecting member 550 to a second connecting member 560. In the illustrated embodiment, bisector 540 extends beyond second connecting member 560 and is provided with a notch that forms a hook 570 that may be used to hold an additional item, such as a hand bag 580 or a cane or the like.

Figure 7:
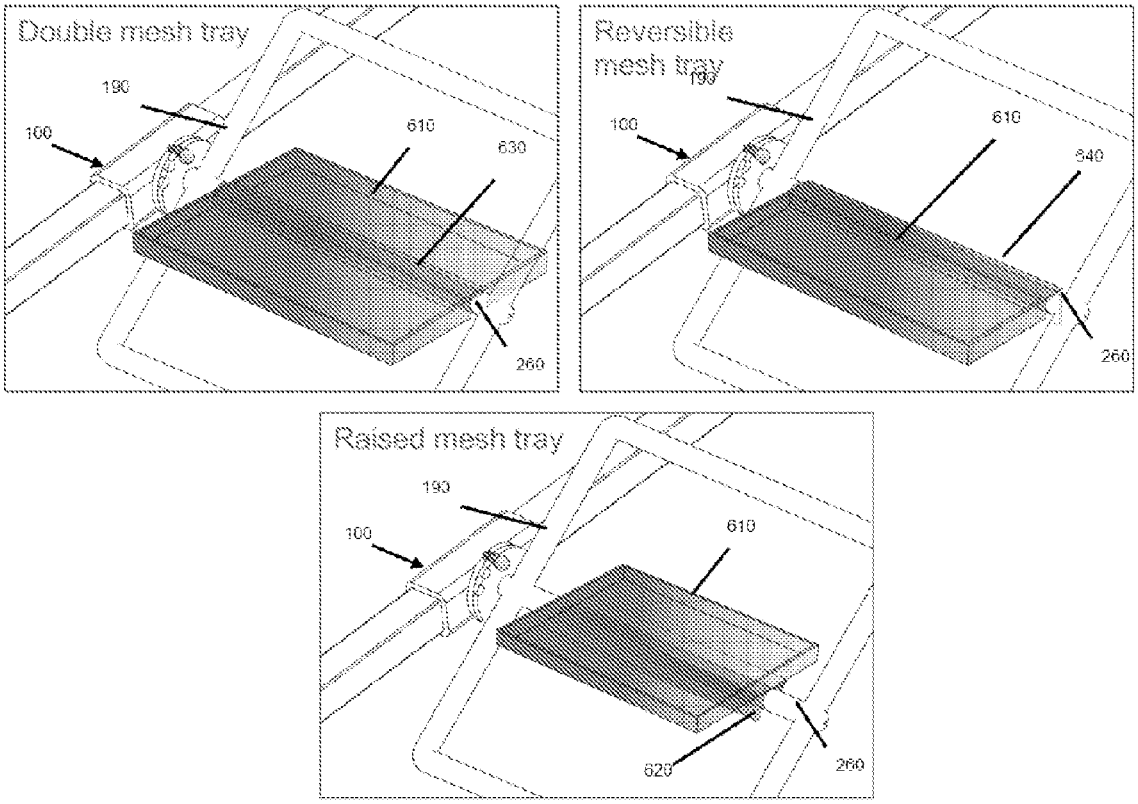
FIG. 7 shows additional features that may be added on to the embodiment of FIG.

FIG. 7 shows various add-on features that may be implemented in the handle frame 240 of support assembly 100 according to FIG. 1. In some embodiments, various configurations of trays 610 may be included that may be fixed to a bisector 260 traveling from the first connecting member 190 to the second connecting member 230. In one example, a tray 610*a* may rest above bisector 260 and maintain stability through the use of a gripping element 620 that attaches to bisector 260. Alternatively, a tray 610*b* may be provided with a slot 630 that snugly receives and surrounds bisector 260. In one embodiment, tray 610*c* is half the size of tray 610*a* or 610*b* and may be provided with grips 640 that attach to bisector 260 on only one side. These trays may be fitted with cup holders, bottle holders, magazine racks, pill holders, or a specialized support for another item. In addition to a tray, add on features may further comprise cup holders, hooks, racks configured for specified items, such as pills, magazines, or books, among other potential features.

Additional add-on devices may be included as well, and may provide added functionality. While the add-on features in the embodiment of FIG. 7 are shown relative to bisector 260, in some embodiments (not shown), add-on features, such as trays, may be implemented where no bisector is present. In some non-limiting embodiments, a tray or basket may be fitted to match the shape of handle frame 240 while leaving space for grasping grips 150, 160.

While the support assembly in the various embodiments described herein is shown with certain configurations and constructions, it will be understood that many features of the support sleeve, handle and handle frame, as well as the rail, may be varied without altering the nature of the elements, and as such the elements discussed may be implemented in a variety of ways. Features that may be varied include, but are not limited to, the shape of the handle frame, the contact points between the support sleeve and the rail, the grips on the handle, the systems for locking the handle frame in specified positions relative to the central axis, as well as the systems for expanding and contracting the distance between the grips and the central axis.

The support assembly may be constructed in different ways and out of different materials and may be configured to achieve additional benefits. In some embodiments, the support assembly is specifically configured for a user to ascend and descend stairs, and the support assembly is designed so that user does not contact the grip when raising or lowering his or her legs. In some embodiments, the grips rotate about the central axis so that a user that maintains a different posture at different times of day may be able to use the support assembly over the course of the day with minimal adjustments. Similarly, the expansion and contraction of the distance between the grips and the central axis allow users of different heights to easily adapt the support assembly for use. Further, when the support assembly is used for ascending and descending stairs, the assembly is generally angled so that the grips point upwards towards the top of the stairs and downwards towards the bottom of the stairs. So that the grip is an appropriate height for a user ascending or descending the stairs. In one embodiment, the support sleeve slides only under a force substantially along the elongated rail, and in one embodiment the support sleeve slides in only one direction at a time along the elongated rail based on a user selection. In such an embodiment, the support assembly further comprises a friction wheel for controlling the direction of travel of the support sleeve.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A support assembly comprising:

an elongated rail;

a support sleeve slidable along the elongated rail;

a handle adjustably attached to the support sleeve and having a central axis, a first grip and a second grip positioned on opposite sides of the central axis;

each grip being connected to the other by first and second connecting members that combine with the first and second grips to form a handle frame;

the support assembly further comprising a bisector connecting the first connecting member to the second connecting member that bisects the handle frame along the central axis;

wherein the support assembly further comprises an additional support feature attached to the handle, and wherein the bisector extends beyond the second connecting member and forms a hook.

2. The support assembly of claim 1, wherein the support sleeve slides only under a force substantially along the elongated rail.

3. The support assembly of claim 2, wherein the support sleeve slides in only one direction at a time along the elongated rail based on a user selection.

4. The support assembly of claim 3, further comprising a friction wheel for controlling the direction of travel of the support sleeve.

5. The support assembly of claim 1, wherein the support sleeve limits a rate of movement of the support sleeve along the elongated rail.

6. The support assembly of claim 1, wherein the handle frame is rotatable about the central axis.

7. The support assembly of claim 6, further comprising a locking mechanism for fixing the orientation of the handle frame about the central axis.

8. The support assembly of claim 1, wherein the handle frame is substantially rectangular.

9. The support assembly of claim 1, wherein the first grip and the second grip are arched towards the central axis.

10. The support assembly of claim 8, wherein additional gripping elements are located at each corner of the handle frame.

11. The support assembly of claim further comprising one or more of a tray, a hook or a magazine rack attached to the bisector.

12. The support assembly of claim 1, further comprising an additional support feature attached to the handle.

13. The support assembly of claim 12, further comprising one or more of a tray, a hook or a magazine rack attached to the handle.

14. A support assembly comprising:

an elongated rail;

a support sleeve slidable along the elongated rail;

a handle adjustably attached to the support sleeve and having a central axis, a first grip and a second grip positioned on opposite sides of the central axis;

each grip being connected to the other by first and second connecting members that combine with the first and second grips to form a handle frame, wherein the first connecting member and the second connecting member are extendable to vary the distance between the central axis and each of the grips.

15. The support assembly of claim 14, wherein the distance between each of the grips and the central axis can be varied independently of each other.

16. A support assembly comprising:

an elongated rail;

a support sleeve slidable along the elongated rail;

a handle adjustably attached to the support sleeve and having a central axis, a first grip and a second grip positioned on opposite sides of the central axis;

each grip being connected to the other by first and second connecting members that combine with the first and second grips to form a handle frame, wherein the connecting members extend telescopically.

* * * * *